US010648629B2

(12) United States Patent
Miller

(10) Patent No.: US 10,648,629 B2
(45) Date of Patent: May 12, 2020

(54) EXPANDABLE NET LIGHT FOR DECORATIVE ILLUMINATION

(71) Applicant: J. Chris Miller, Woodstock, GA (US)

(72) Inventor: J. Chris Miller, Woodstock, GA (US)

(73) Assignee: Wintergreen Corporation, Alpharetta, GA (US)

( * ) Notice: Subject to any disclaimer, the term of this patent is extended or adjusted under 35 U.S.C. 154(b) by 0 days.

(21) Appl. No.: 16/160,954

(22) Filed: Oct. 15, 2018

(65) Prior Publication Data

US 2019/0113188 A1 Apr. 18, 2019

Related U.S. Application Data

(60) Provisional application No. 62/573,114, filed on Oct. 16, 2017.

(51) Int. Cl.

| | |
|---|---|
| ***F21S 4/15*** | (2016.01) |
| ***F21V 21/08*** | (2006.01) |
| ***F21V 23/02*** | (2006.01) |
| ***F21V 23/06*** | (2006.01) |

(52) U.S. Cl.

CPC ..... *F21S 4/15* (2016.01); *F21V 21/08* (2013.01); *F21V 23/02* (2013.01); *F21V 23/06* (2013.01)

(58) Field of Classification Search

CPC .. F21S 4/15; F21V 21/08; F21V 23/02; F21V 23/06

See application file for complete search history.

(56) References Cited

U.S. PATENT DOCUMENTS

| | | | | |
|---|---|---|---|---|
| 5,424,925 | A * | 6/1995 | Jenke | F21S 4/10 362/103 |
| 2005/0239342 | A1 | 10/2005 | Moriyama et al. | |
| 2009/0184617 | A1 | 7/2009 | Weekamp | |
| 2010/0286910 | A1* | 11/2010 | Hudson | F21S 4/10 701/469 |
| 2014/0340857 | A1* | 11/2014 | Hsu | H05K 1/0283 361/749 |
| 2015/0216037 | A1* | 7/2015 | Tomita | H01L 24/19 174/251 |
| 2015/0263256 | A1 | 9/2015 | Hsieh et al. | |

* cited by examiner

*Primary Examiner* — Mary Ellen Bowman

(74) *Attorney, Agent, or Firm* — FisherBroyles, LLP; Rachel H. Huffstetler

(57) ABSTRACT

An expandable net light defined by a matrix of connectors for supporting light members. The matrix includes conductive and non-conductive connectors wherein the non-conductive or both connectors are expandable. The conductive connectors define an electrical circuit within the matrix permitting expansion of the net light.

16 Claims, 4 Drawing Sheets

EXPANDABLE NET LIGHT FOR DECORATIVE ILLUMINATION

CROSS REFERENCE TO RELATED APPLICATIONS

This application claims the benefit of and priority to U.S. Provisional Patent Application Ser. No. 62/573,114, filed Oct. 16, 2017, the disclosure of which is hereby incorporated by reference.

FIELD OF THE INVENTION

The present invention is directed to a net light and, more specifically, to an expandable matrix for supporting light members so as to form a net which may be used for decorative or other purposes. The expandable matrix includes conductive connectors between adjacent light members and non-conductive, expandable connectors between other adjacent light members wherein the connectors substantially define a matrix having rows and columns for supporting the light members. The conductive connectors may also be expandable.

BACKGROUND OF THE INVENTION

Decorative lights for illuminating indoor and outdoor structures, such as for celebrations or holidays, is commonplace. Originally, this was accomplished by wrapping a structure, such as a shrub, with string lights which are either wrapped around or tucked into the interior of the shrub. Net lights became popular for these purposes and greatly improved the installation of such lighting. Conventional net lights are string lights that have been formed into a grid, which may easily cover the exterior of a structure, such as bushes or tree trunks, in a fast and easy installation process. The grid of conventional net lights usually includes lights supported by connectors, at intersections of intersecting connectors, defining the grid. The connectors in one direction are conductive whereas the connectors in the other direction are structural and may not be conductive. Together, the connectors define the rows and columns of the matrix or grid. As such, the width and length of the matrix are fixed and define the area to be covered. Conventional net lights do not provide for expansion in all directions, including, for example, in the series of connectors provided to conduct electricity. This results in a cumbersome net light in terms of installation, removal and storage. This also results in a net light susceptible to tangling.

SUMMARY OF THE INVENTION

It is, therefore, advantageous for a net light which may be easily stored, transported, installed and removed. It is also advantageous to provide a net light which is expandable in one or both directions, including in the rows or columns providing conductivity to the light members.

The present invention overcomes shortcomings of the prior art by providing a novel expandable net light defined by a net including connectors defining a matrix configuration for supporting light sources, such as at the intersection of intersecting connectors. The connectors may include conductive and non-conductive members. The net is expandable in both directions, longitudinal and lateral, or is expandable in one direction only. According to one aspect, the net as disclosed is expandable even in the direction (row or column of the matrix) of connectors arranged in series to conduct electrical current to the light source. These and other objectives are met by the present invention.

DETAILED DESCRIPTION OF THE INVENTION

The present invention will now be described in detail hereinafter by reference to the accompanying drawings. The invention is not intended to be limited to the embodiments described; rather, this detailed description is provided to enable any person skilled in the art to make and practice the invention.

As used herein, the terms "lateral" and "longitudinal" are used to refer to intersecting directions. The term "fore end" refers to the net light end adjacent the power source and term "aft end" refers to the opposite end which, as shown, is the end of the net light for securing the net light, such as its bottom, for securing to the ground if used to illuminate a shrub, for example. The term "transverse" direction refers to a direction which intersects the longitudinal or lateral axis, at any angle. The term "matrix" refers to any at least two-dimensional array or grid which includes a predetermined number of rows and columns which may or may not be a square. For example, the intersecting rows and columns may not be extending longitudinally or laterally but may extend at angle transverse to the horizontal or longitudinal axes', such as in a diamond or triangular pattern. The matrix is capable of forming any two- or three-dimensional configuration. Moreover, the laterally extending portions of the net light may be non-conductive and the longitudinally extending portions may be conductive, vice versa, or a combination thereof. The longitudinally extending and laterally extending connectors intersect transversely (perpendicularly or at any angle). The lateral and longitudinal connectors as shown are substantially parallel, but it is envisioned that they extend in a non-parallel configuration.

Figure 1:
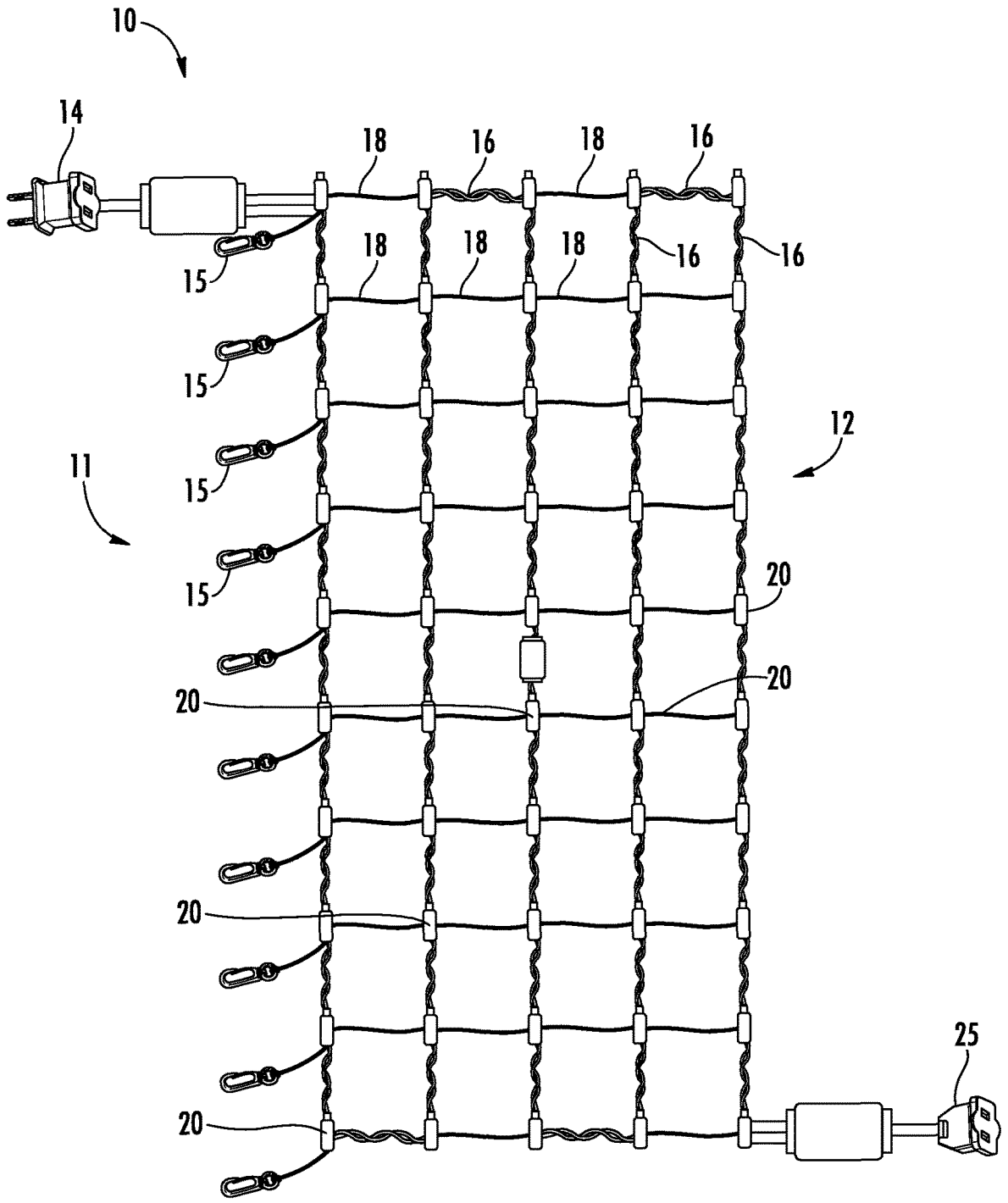
FIG. 1 is a plan view of an expandable net light having conducting connectors according to one aspect of the invention and a matrix formed of conductors in a first predetermined series.

As shown in FIG. 1, the expandable net light 10 includes a fore end 11 and an aft end 12. The fore end 11 is adjacent the electrical connector 14 for connecting to a power source. The aft end 12 comprises fasteners 15 for selectively securing the net light 10. The fasteners 15 may be positioned along any end surface of said net light 10 matrix or along any surface thereof. As shown, the fore end 11 defines the top of the net light 10 and the aft end 12 defines the bottom, but these may be provided on any of the four sides of the net light 10. (This is shown left to right in the Figures.)

The net light 10 comprises a matrix of connectors including connectors extending in a first direction, e.g., longitudinal connectors (as shown, extending left to right) and connectors extending in a second direction, e.g., lateral connectors (as shown, extending top to bottom) for supporting light members 20. The first connectors 16 are conductive and are positioned so as to define a circuit for conducting electrical current throughout the net light 10 to be delivered to the light members 20. As shown in FIG. 1, the conductive connectors 16 extend from the power source connector 14, along the longitudinal length of fore end 11, across at least one lateral connector, along the longitudinal length of an adjacent column, across at least one lateral connection, along the longitudinal length of an adjacent column, and so one until the circuit is completed at an electrical junction 25. The electrical junction 25 is provided to selectively connect with another fixture, such as another net light 10, if desired. The electrical junction 25 may be located at any desired location along the net light 10. Of course, the electrical circuit of the net light 10 may terminate at the last light member 20 to be illuminated.

Figure 2:
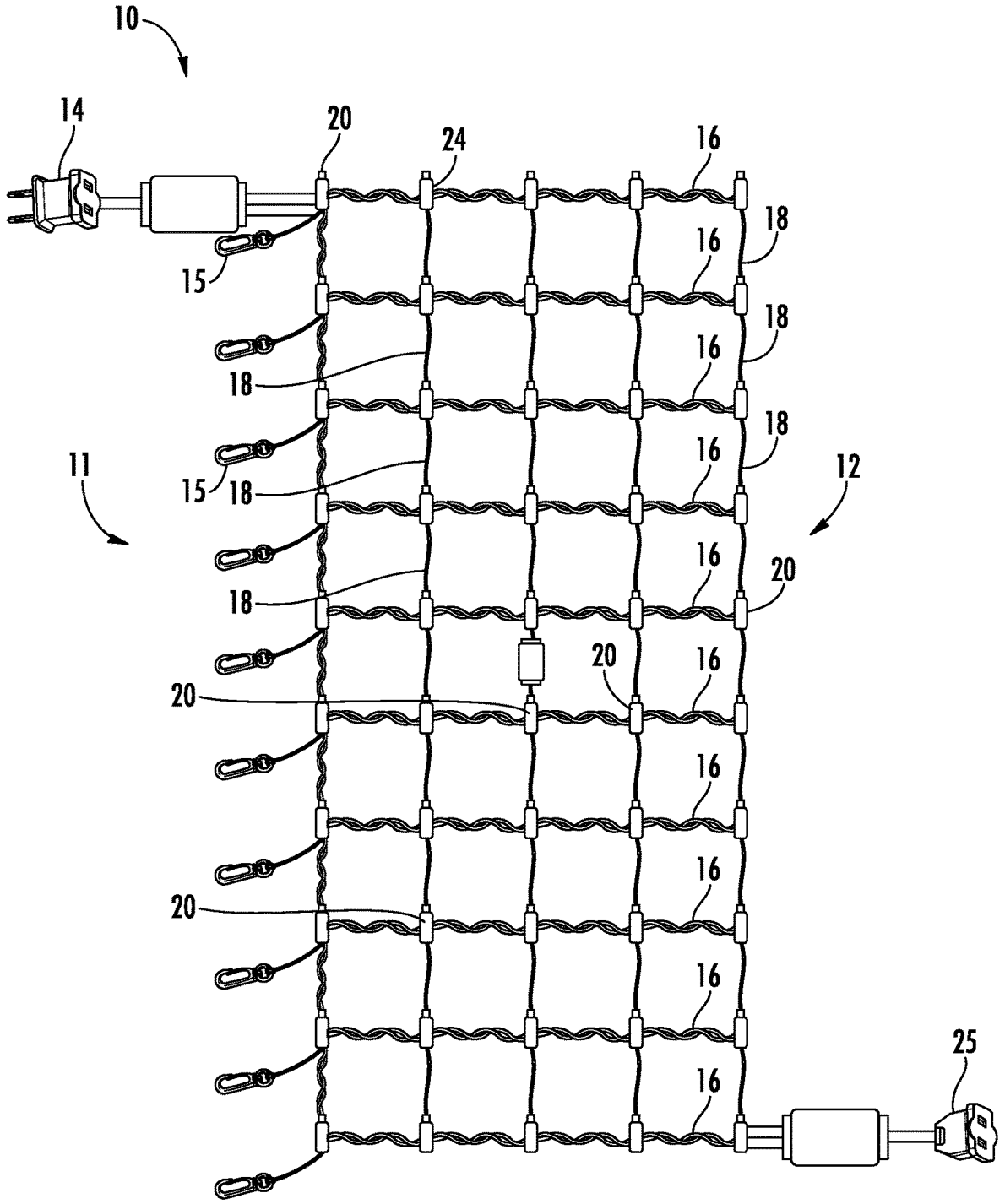
FIG. 2 is a plan view of the expandable net light of FIG. 1 having a matrix formed of conductors in a second predetermined series.

The connectors 18 which do not form part of the electrical circuit as shown in FIGS. 1 and 2, are expandable. Alternatively, the connectors 18 may also be conductive. The connectors 18 may be formed of an elastic cord comprising one or more elastic strands forming a core and covered in a woven cotton or polypropylene sheath to provide expansive properties to the net light 10. As shown in FIG. 1, the net light is expandable in the lateral direction due, at least in part, to the configuration of the elastic lateral connectors 18.

FIG. 2 illustrates another aspect wherein the net light 10 matrix defines a different circuit for delivering power from the power connector 14 to the light members 20. As shown, the conductive connectors 16 extend from the power connector 16, along a first length from the fore end 11 to the aft end 12 and laterally from the first length to the aft end 12 along parallel lateral connectors 16 of the matrix. The other, or non-conductive, connectors 18 forming the matrix, are expandable. Accordingly, the net light shown in FIG. 2 is longitudinally expandable as depicted. Various other circuit configurations for the conductive connectors 16 are envisioned and these are provided by way of example.

Figure 3:
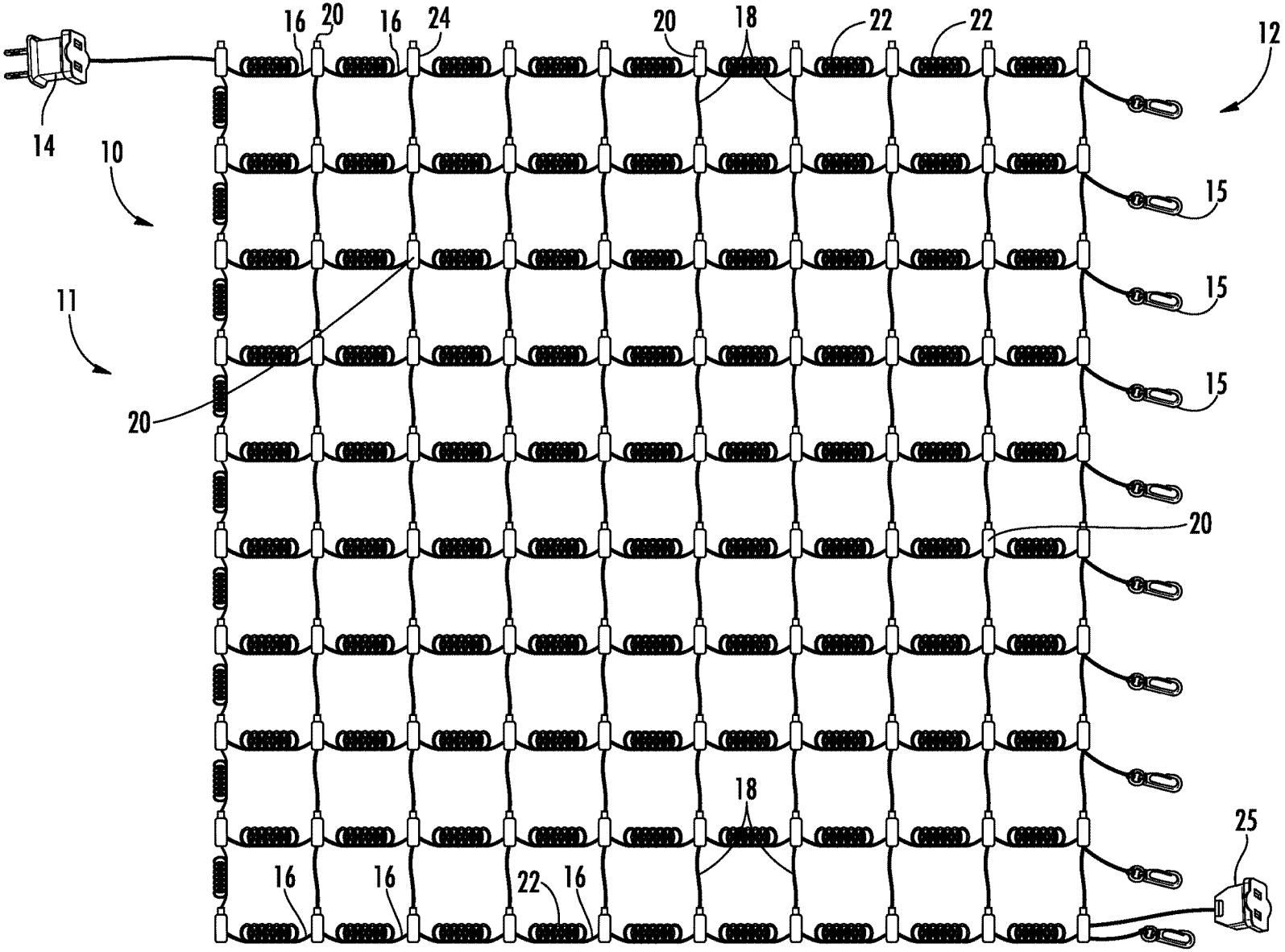
FIG. 3 is a front elevational view of an expandable net light having conducting connectors according to another aspect of the invention and a matrix formed of conductors in a third predetermined series.
Figure 4:
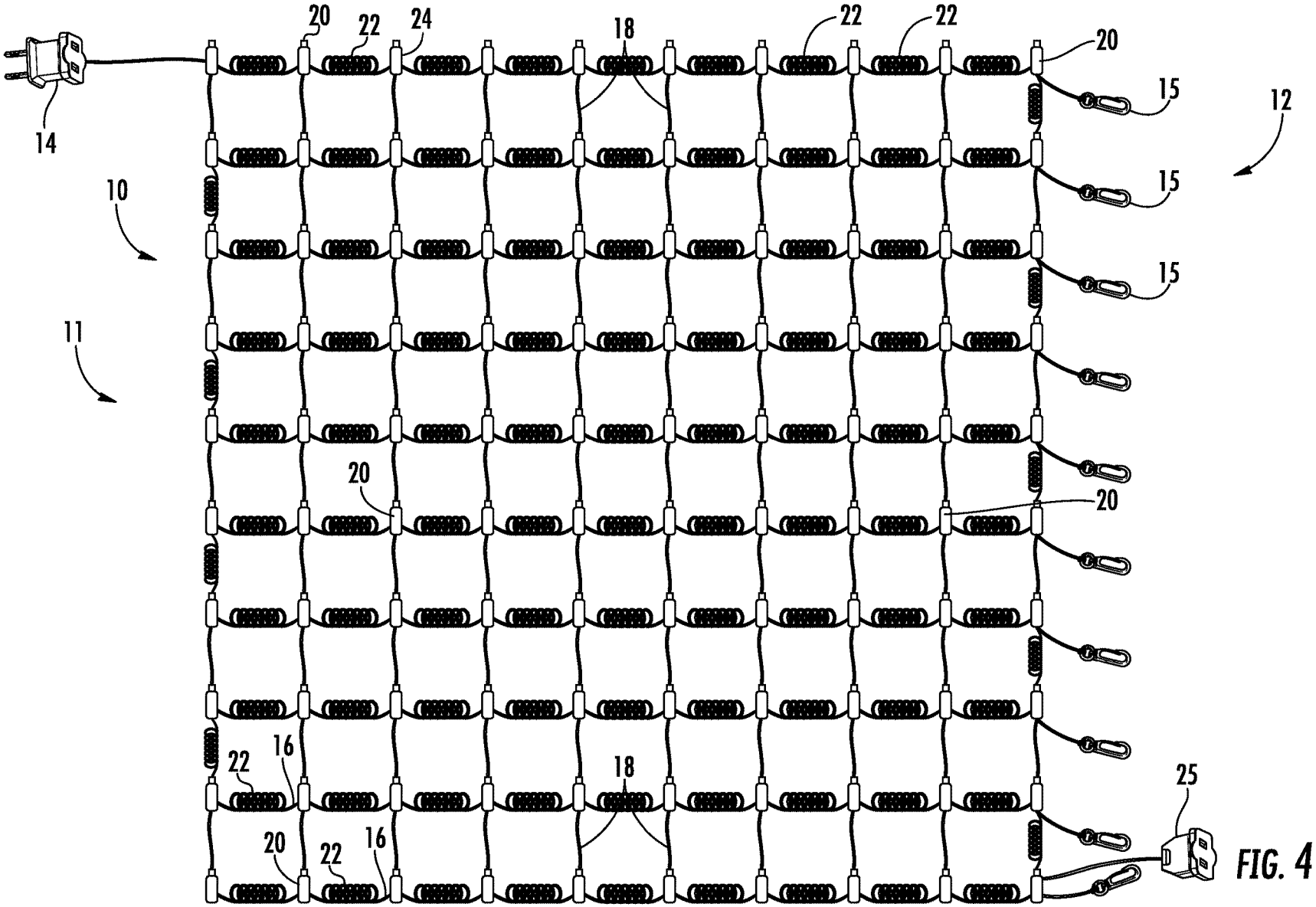
FIG. 4 is a front elevational view of the expandable net light of FIG. 3 having a matrix formed of conductors in a fourth predetermined series.

The net light 10 illustrated in FIGS. 3 and 4 are expandable in both the longitudinal and lateral directions and include expandable conductive connectors 16. The conductive connectors 16 include a coiled portion 22 extending between adjacent light members 20. The coiled portion 22 includes a conductive material, i.e., wire, which is encapsulated by a polymeric material, e.g., PVC, providing the inherent flexibility to be extended and retracted while preventing tangling. The coiled portion 22 is biased in a coiled position as shown. Tension applied to the fore 11 and/or aft ends 12 and/or transverse sides of the net light 10 extend the coiled portion 22 between a coiled position to a fully extended position rendering the conductive connectors substantially straight (and positions therebetween). This enables the net light 10 to be expanded, including along the conductive connectors 16.

The second connectors 18 are non-conductive as shown but may also be formed of a conductive material. The connectors 18 may be formed of an elastic cord comprising one or more elastic strands forming a core and covered in a woven cotton or polypropylene sheath. The connectors 18 enable the net light 10 expand in the direction of the non-conductive connectors 18. Together, the first conductive connectors 16 and second connectors 18 provide a net light 10 which is expandable in transverse directions. It is within the scope of the invention for the net light 10 to be expandable in one or more directions and along either one of the conductive or non-conductive connectors, or along both.

The electrical circuit of the net light 10 shown in FIG. 4 is similar to the circuit shown in FIG. 1 wherein the conductive connectors 16 follow a generally sinusoidal pattern. The electrical circuit of the net light 10 shown in FIG. 3 is similar to the circuit shown in FIG. 2 wherein the connectors 16 extend along the fore end 11 and laterally therefrom to the aft end 12.

The light members 20 are positioned at intersections of the first 16 and second 18 connectors for sufficient support. The light members 20, however, may be positioned anywhere along the surface of the matrix. That is, anywhere in connection with a conductive connector 16 and may form a discontinuous design as well as a matrix design. The light members include a light husk 24 for supporting a desired bulb. The light members may be LED or incandescent, for example. Moreover, the power source shown and described above provides for an electrical connection. It is within the scope of this disclosure, however, to provide a battery, solar or other power source for operating the net light 10.

While exemplary embodiments have been shown and described above for the purpose of disclosure, modifications to the disclosed embodiments may occur to those skilled in the art. The disclosure, therefore, is not limited to the above precise embodiments and that changes may be made without departing from its spirit and scope.

What is claimed is:

1. An expandable net light for decorative illumination comprising:

a net defined by a matrix configuration defined by columns extending in a first direction and rows extending in a second direction generally transverse to said first direction;

a power connector operatively connected to said net for connecting to a power source;

at least one light positioned along a surface of said matrix of said net wherein said at least one light is operatively connected to said power connector;

an electrical circuit extending along said matrix and defining portions thereof for providing power from said power source to said at least one light, said circuit comprising a plurality of conductive connectors in a first predetermined configuration wherein said conductive connectors are formed of a material that is substantially non-expandable and define the matrix rows and columns included in said circuit;

a plurality of expandable and non-conductive connectors defining at least a portion of said matrix and being configured and positioned to provide elastic properties along a portion of said matrix wherein said net is expandable in at least one of said first and second directions, said at least one of said first and second directions being substantially parallel to said plurality of expandable and non-conductive connectors.

2. The expandable net light according to claim 1 wherein said conductive connectors include a coiled portion which is moveable from a first, biased coiled position to a second uncoiled position.

3. The expandable net light according to claim 1 further comprising a plurality of lights positioned along said matrix surface wherein said lights are operatively connected to one another and said power source.

4. The expandable net light according to claim 3 wherein said plurality of lights are each position at an intersection of said matrix rows and columns.

5. The expandable net light according to claim 1 wherein said expandable non-conductive connectors are formed of an elastic material.

6. The expandable net light according to claim 1 where said matrix rows extend substantially perpendicular to said matrix columns.

7. The expandable net light according to claim 1 wherein said circuit first predetermined configuration is defined by conductive connectors extending along the length of one of said columns of said matrix, extending along at least a first transverse connector transverse to said one column, and extending along the length of a second column transverse to said at least one transverse connector.

8. The expandable net light according to claim 7 wherein said non-conductive expandable connectors define the matrix rows and columns not included in said circuit.

9. The expandable net light according to claim 1 wherein said circuit first predetermined configuration is defined by conductive connectors extending at least along a length of one of said columns of said matrix between two rows of said matrix and extending along said at least two rows of said matrix.

10. The expandable net light according to claim 1 where said power source is an electrical power source.

11. An expandable net light for decorative illumination comprising:

a net defined by a matrix configuration defined by columns extending in a first direction and rows extending in a second direction generally transverse to said first direction;

a power connector operatively connected to said net for connecting to a power source;

at least one light positioned along a surface of said matrix of said net wherein said at least one light is operatively connected to said power connector;

a plurality of expandable and non-conductive connectors defining at least a portion of said matrix and being configured and positioned to provide elastic properties along a portion of said matrix wherein said net is expandable in at least one of said first and second directions, an electrical circuit extending along said matrix and defining portions thereof for providing power from said power source to said at least one light, said circuit comprising a plurality of conductive connectors extending in at least one of said first and second directions in a first predetermined configuration wherein said conductive connectors extending in at least one of said first and second directions include a coiled portion which is moveable from a first, biased coiled position to a second uncoiled position wherein said net light is expandable in said at least on of said first and second directions including said conductive connectors.

12. The expandable net light according to claim 1 further comprising a plurality of lights positioned along said matrix surface wherein said lights are operatively connected to one another and said power source.

13. The expandable net light according to claim 3 wherein said plurality of lights are each position at an intersection of said matrix rows and columns.

14. The expandable net light according to claim 1 where said matrix rows extend substantially perpendicular to said matrix columns.

15. The expandable net light according to claim 11 wherein said circuit first predetermined configuration is defined by said conductive connectors extending along the length of one of said columns of said matrix, extending along at least a first transverse connector transverse to said one column, and extending along the length of a second column transverse to said at least one transverse connector.

16. The expandable net light according to claim 11 wherein said circuit first predetermined configuration is defined by conductive connectors extending at least along a length of one of said columns of said matrix between two rows of said matrix and extending along said at least two rows of said matrix.

* * * * *